US006370846B1

(12) United States Patent
Schoch et al.

(10) Patent No.: US 6,370,846 B1
(45) Date of Patent: Apr. 16, 2002

(54) CUTOUT FOR A CIGARETTE PACKAGE

(75) Inventors: Reinhard A. Schoch, Hamburg; Uwe I. Meier, Norderstedt; H. H. D. Friedrich, Hamburg, all of (DE)

(73) Assignee: H.F. & Ph.F. Reemtsma GmbH, Hamburg (DE)

( * ) Notice: Subject to any disclaimer, the term of this patent is extended or adjusted under 35 U.S.C. 154(b) by 0 days.

(21) Appl. No.: 09/462,469

(22) PCT Filed: Jul. 6, 1998

(86) PCT No.: PCT/EP98/04131

§ 371 Date: Feb. 18, 2000

§ 102(e) Date: Feb. 18, 2000

(87) PCT Pub. No.: WO99/02428

PCT Pub. Date: Jan. 21, 1999

(30) Foreign Application Priority Data

Jul. 9, 1997 (DE) ..... 197 30 266
Jul. 29, 1997 (DE) ..... 197 33 604

(51) Int. Cl.[7] ..... B65B 43/08

(52) U.S. Cl. ..... 53/456; 53/228; 53/377.4; 53/376.5; 206/259; 206/268

(58) Field of Search ..... 53/456, 466, 228, 53/444, 377.4, 376.5; 493/910, 911; 206/242, 259, 268, 273

(56) References Cited

U.S. PATENT DOCUMENTS 4,938,005 A * 7/1990 Focke
5,092,107 A * 3/1992 Lamm
6,113,525 A * 9/2000 Waechter

FOREIGN PATENT DOCUMENTS

| | | | |
|---|---|---|---|
| DE | 1 214 137 | | 3/1963 |
| DE | 3116924 | * | 2/1983 |
| DE | 35 15 775 | | 11/1986 |
| DE | 35 22 614 | | 1/1987 |
| EP | 411223 | | 2/1991 |
| EP | 414532 | | 2/1991 |
| EP | 0 425 068 | | 10/1991 |
| EP | 0 473 320 | | 3/1992 |
| EP | 545723 | | 6/1993 |
| EP | 0 693 441 | | 1/1996 |
| GB | 2 341 846 A | | 3/2000 |

* cited by examiner

*Primary Examiner*—Eugene Kim
(74) *Attorney, Agent, or Firm*—Nixon & Vanderhye

(57) ABSTRACT

The invention relates to a blank for a cigarette pack with an inside part and a casing (4), with a front (12), a back, a base (6), a top (8) and with side sections (16, 18) connecting the front (12) and the back and also with a tearing edge (10). The cigarette pack is characterized in that the side sections (16, 18) are provided with pre-grooved folding lines (17) which allow a semi-circular folding of the inside part and of the casing (4). The invention also relates to a process for the production of a cigarette pack from this blank.

8 Claims, 11 Drawing Sheets

Figure 3:
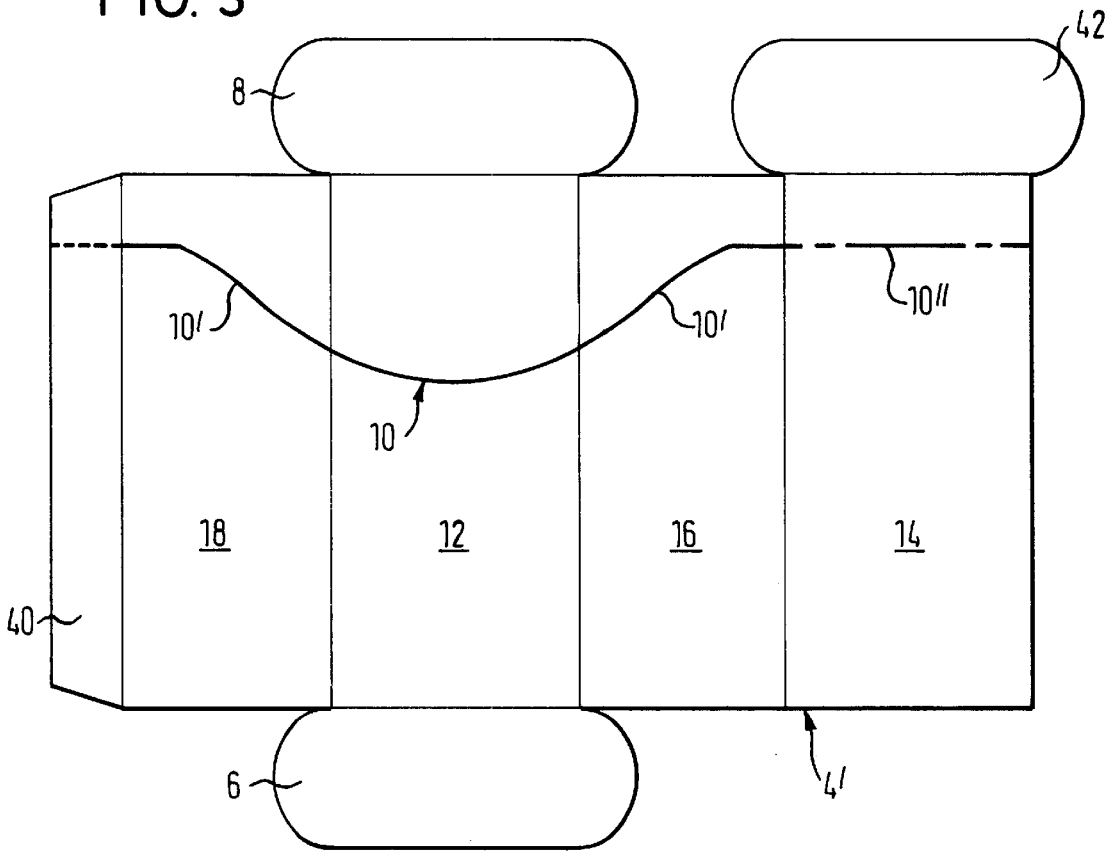

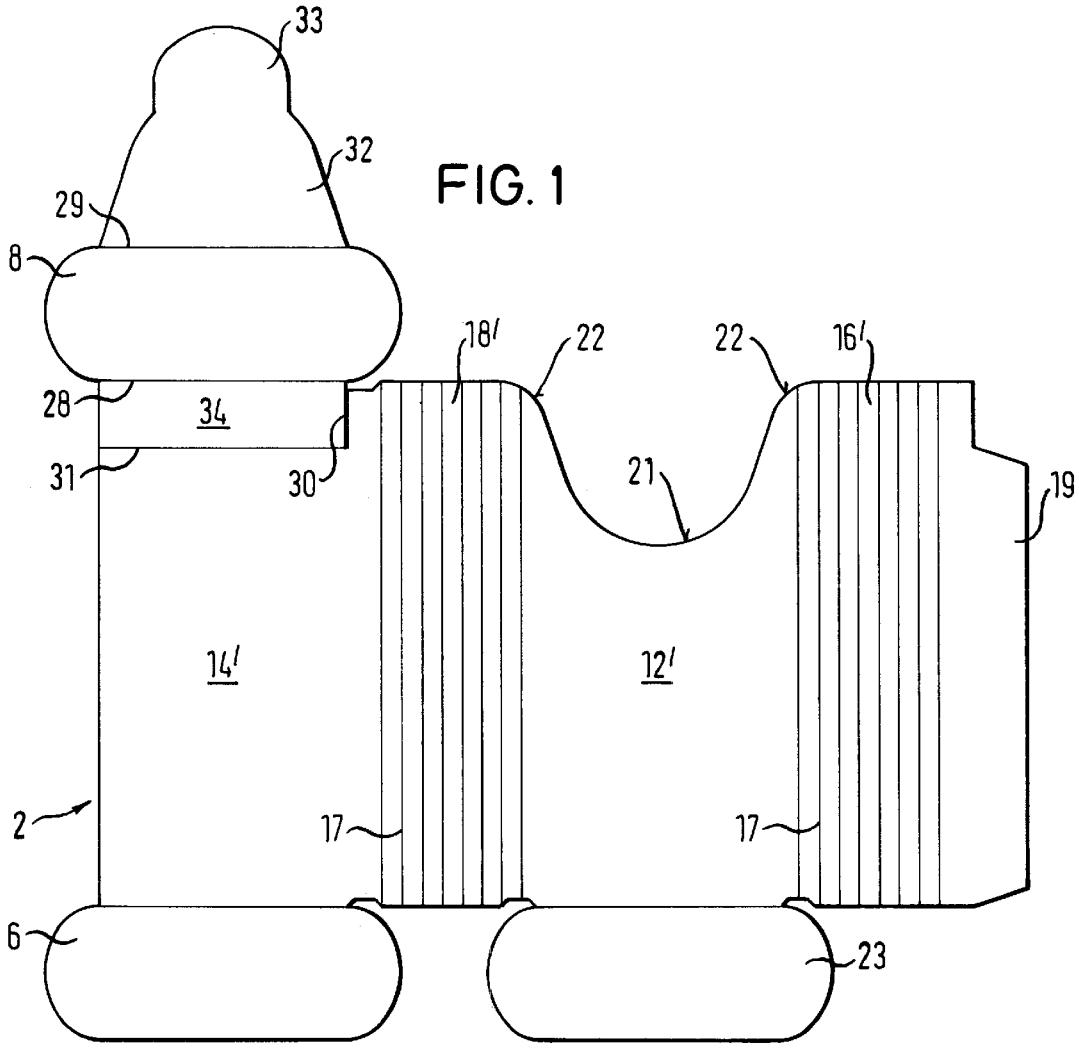
FIG. 1
FIG. 2
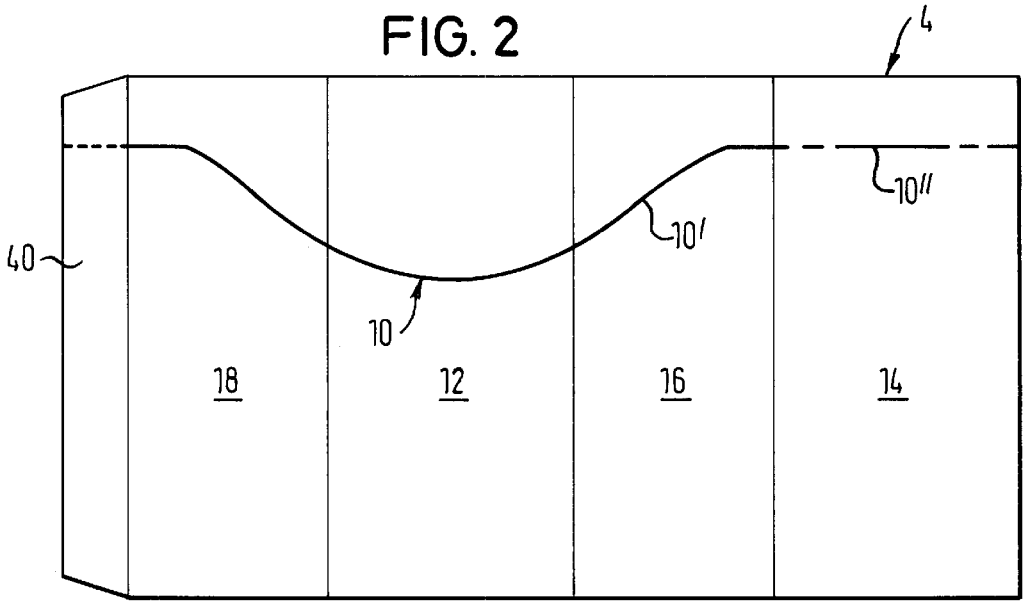

CUTOUT FOR A CIGARETTE PACKAGE

The invention relates to a blank for a cigarette pack.

Numerous blanks for cigarette packs are already known, for example for so-called cap-fold boxes in which a flat blank made from cardboard is provided with folding lines and slots and is assembled into a rectangular block shape when in use.

The object of the invention is to create a blank for a novel cigarette pack which has a form deviating from the rectangular cuboid form with rounded side edges.

The blank according to claim 1 and a process for its production according to claim 6 serve to achieve this object.

Advantageous developments of the invention are the subject of the dependant claims.

With the process according to the invention, the packaging is made from two blanks, namely an inside part blank and a casing blank. First of all the inside part from the relatively easily shaped inside part blank is laid round a format body, then folded or shaped to give an inside part and subsequently glued together, one end of the inside part remaining open in order to remove the format body again in a later step. The inside part is preferably pulled off from the format body immediately after the gluing and pushed into a hollow format body, so that the inside part can then be filled with its contents, thus for example with cigarettes. Subsequent thereto, the inside part is fully sealed and again drawn out of the hollow format body. This possibility offers the advantage that the contents or the product which is now located in the sealed inside part assumes the function of a format body. The casing blank, which is likewise very easily shaped, is then laid round the inside part and glued. The preferred process step of already pulling the inside part off from the format body early and replacing it with the product to be packaged has the advantage that the inside part can now already be sealed, which is not the case when further use is made of the format body, and that the packed product together with the inside part forms a stable format body round which the casing blank can be shaped. Since many fewer bending and gluing operations are necessary with the process according to the invention, the packages can be produced much more quickly. Finally, the required production plant is also less complicated and therefore cheaper and less prone to disruption.

This process is suitable for a large number of different forms of packaging. However, this process is particularly advantageous in the case of packages having rounded or else semi-rounded long sides. In order to make the production of the rounded zones easier, the inside part blank and/or the casing blank can be provided in the rounded zones with several pre-grooved folding lines running in parallel. In this way, packages with different cross-section shapes can be produced.

Figure 4:
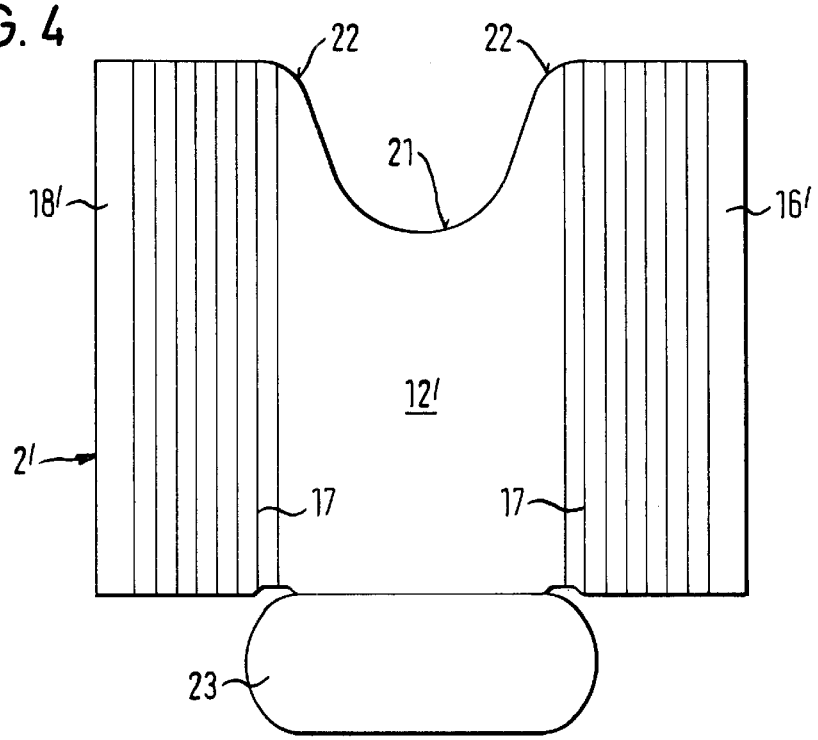
Figure 5:
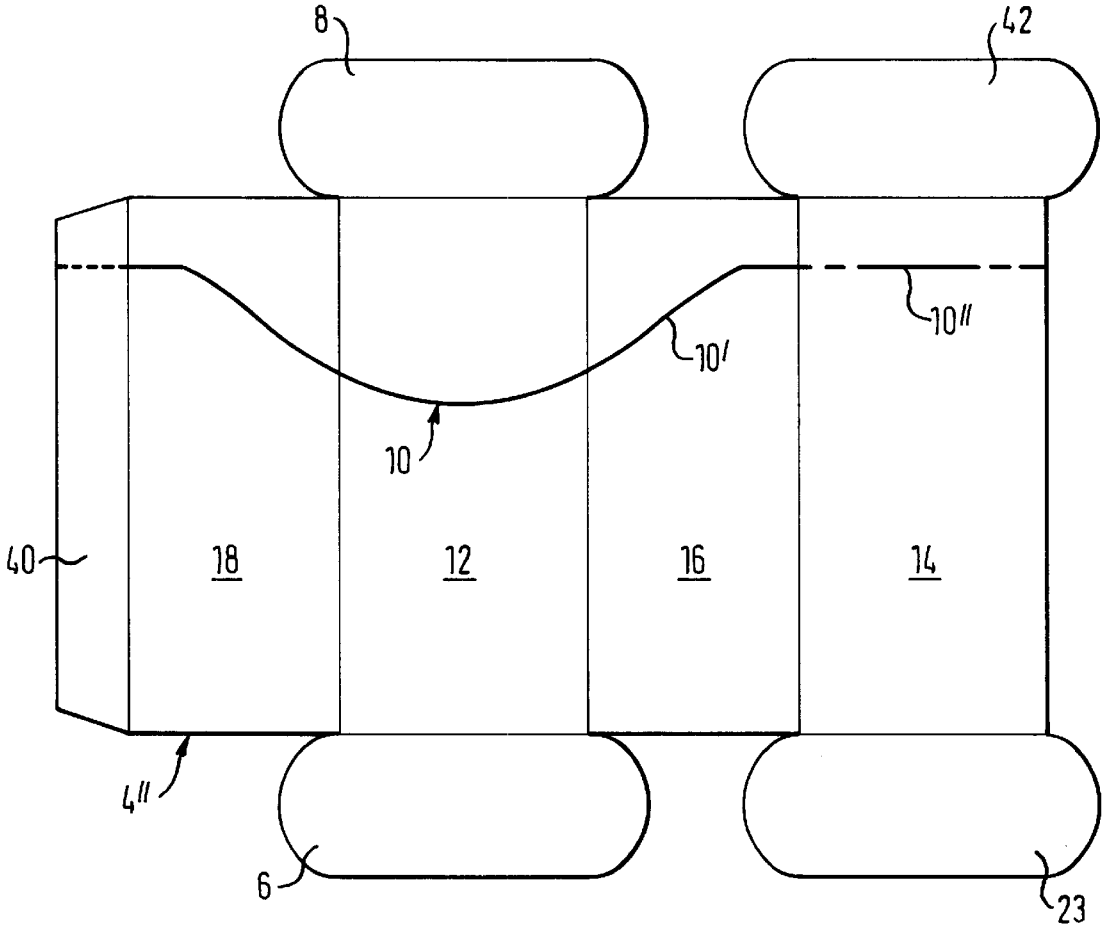
Figure 6:
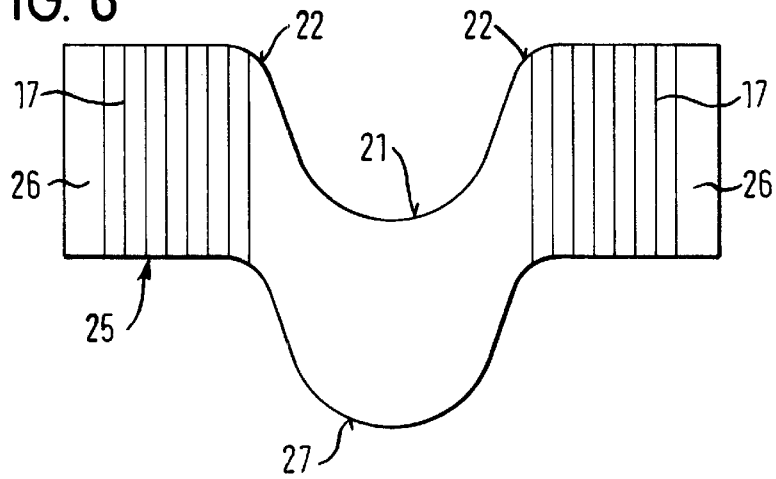
Figure 7:
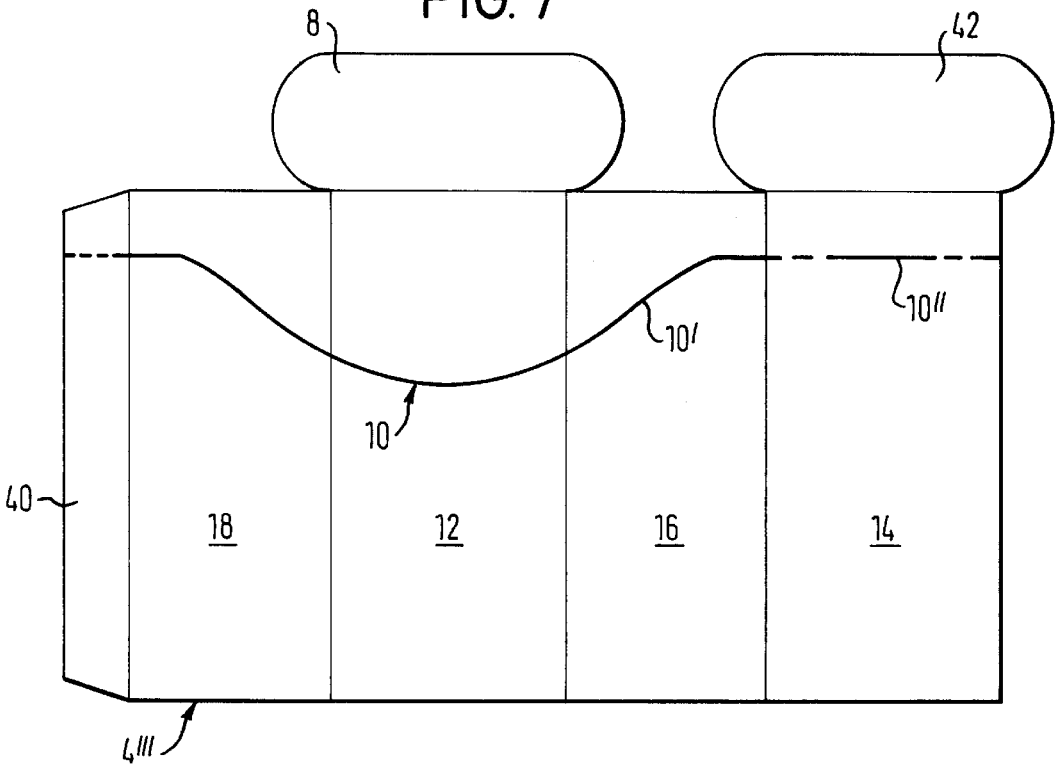
Figure 8:
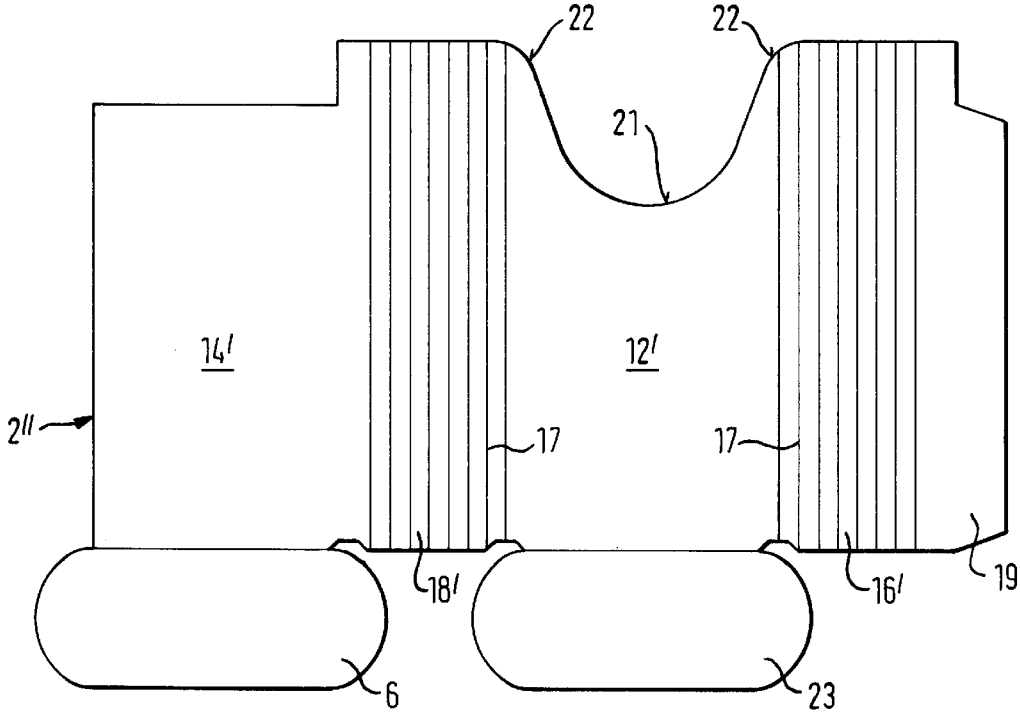
Figure 9:
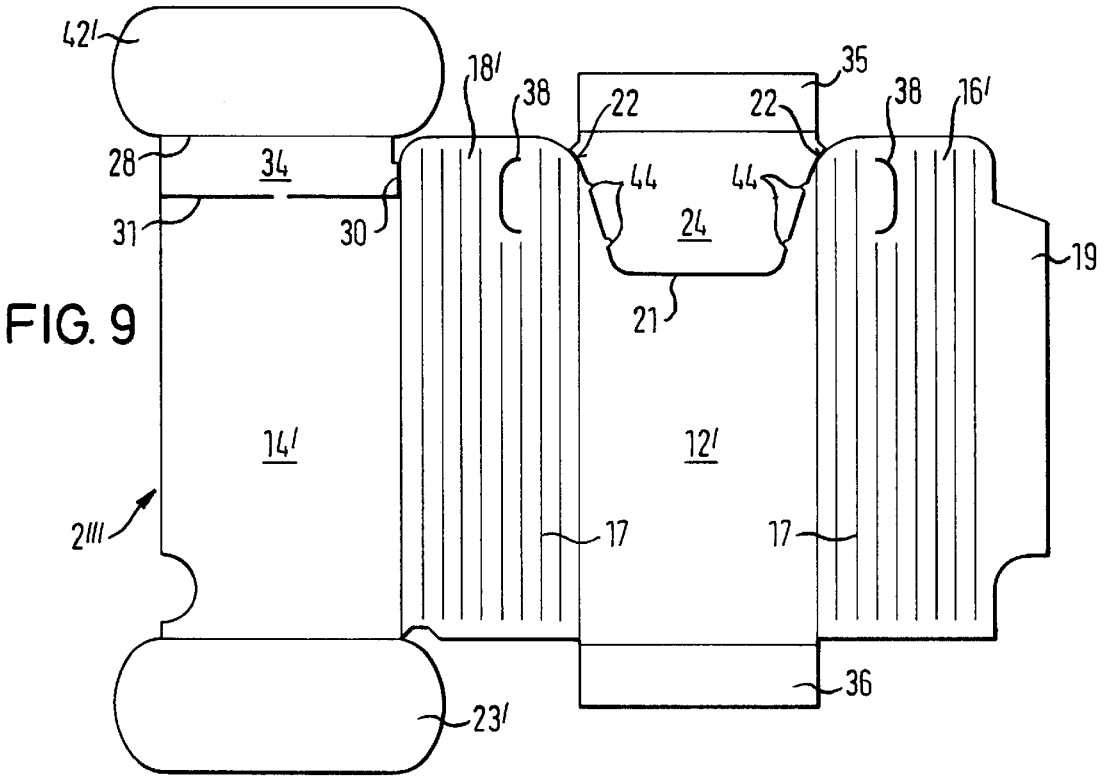
Figure 10:
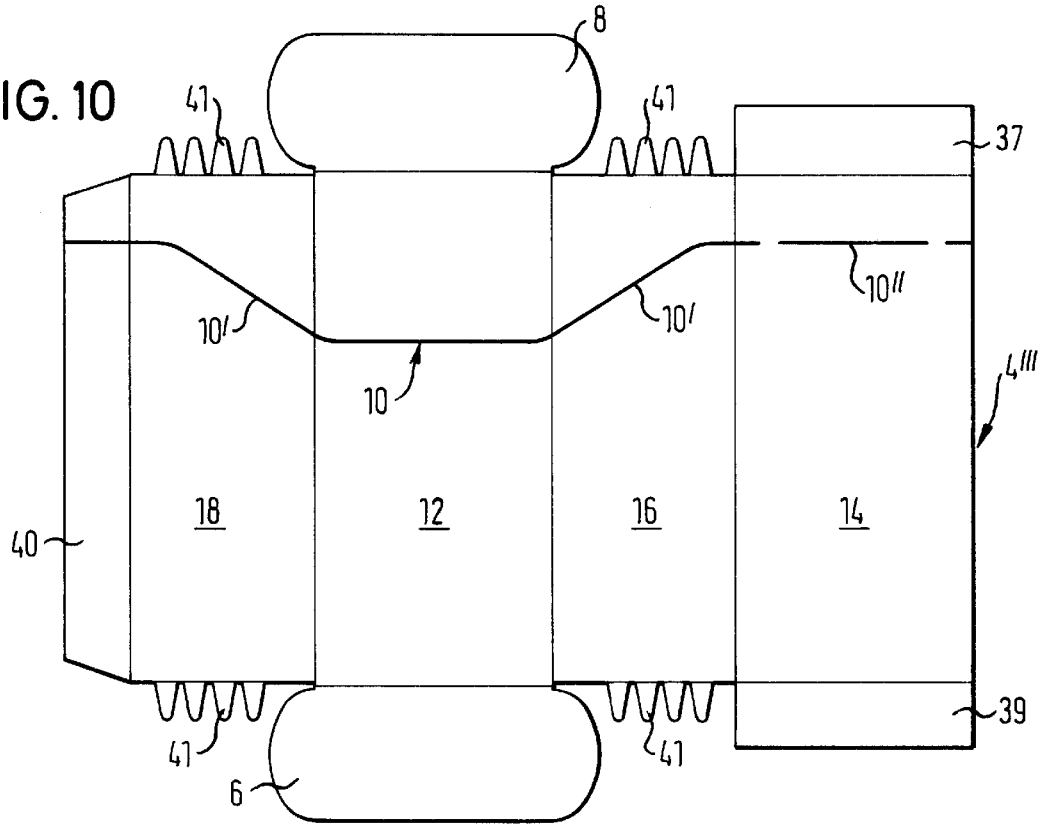
Figure 11:
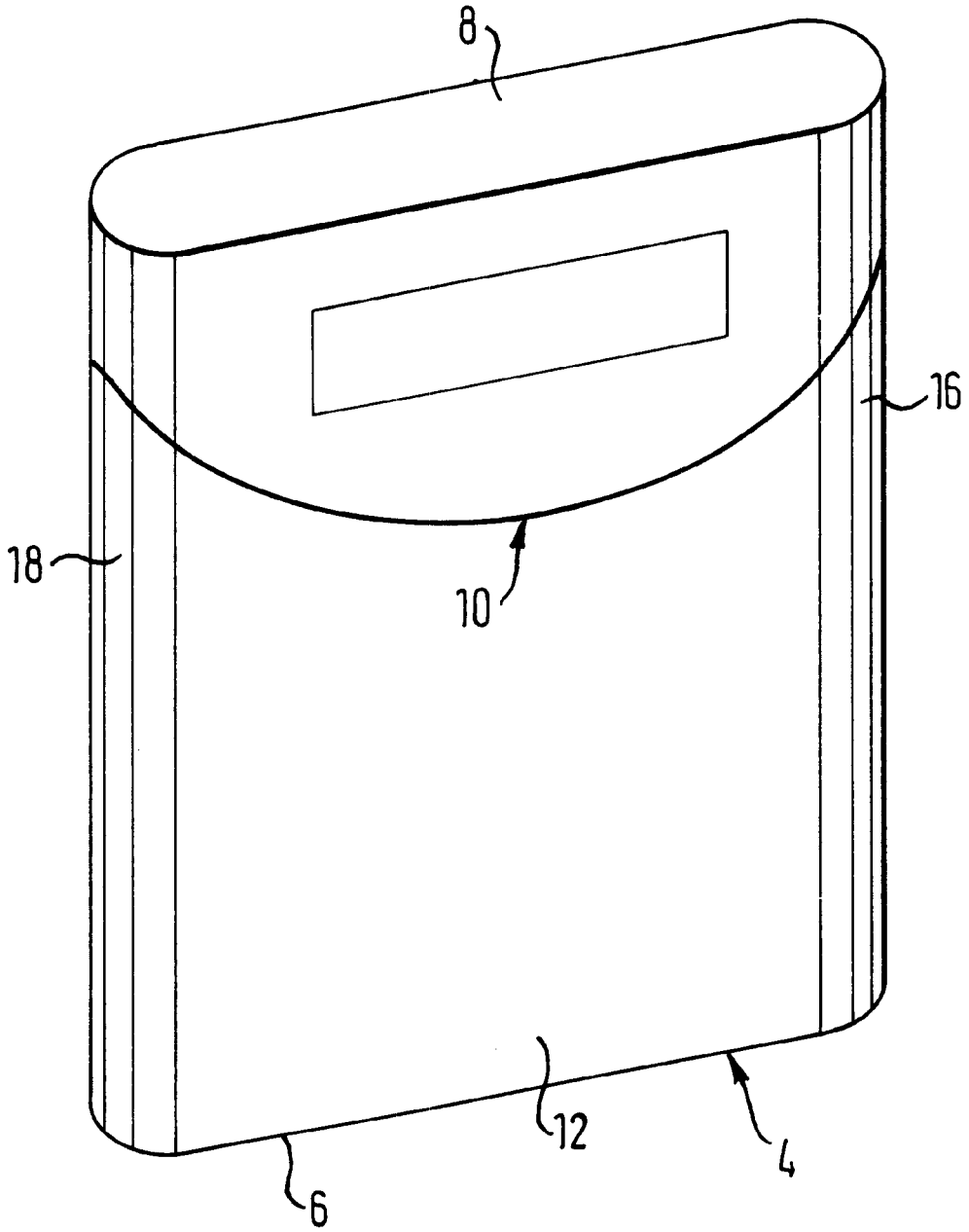
Figure 12:
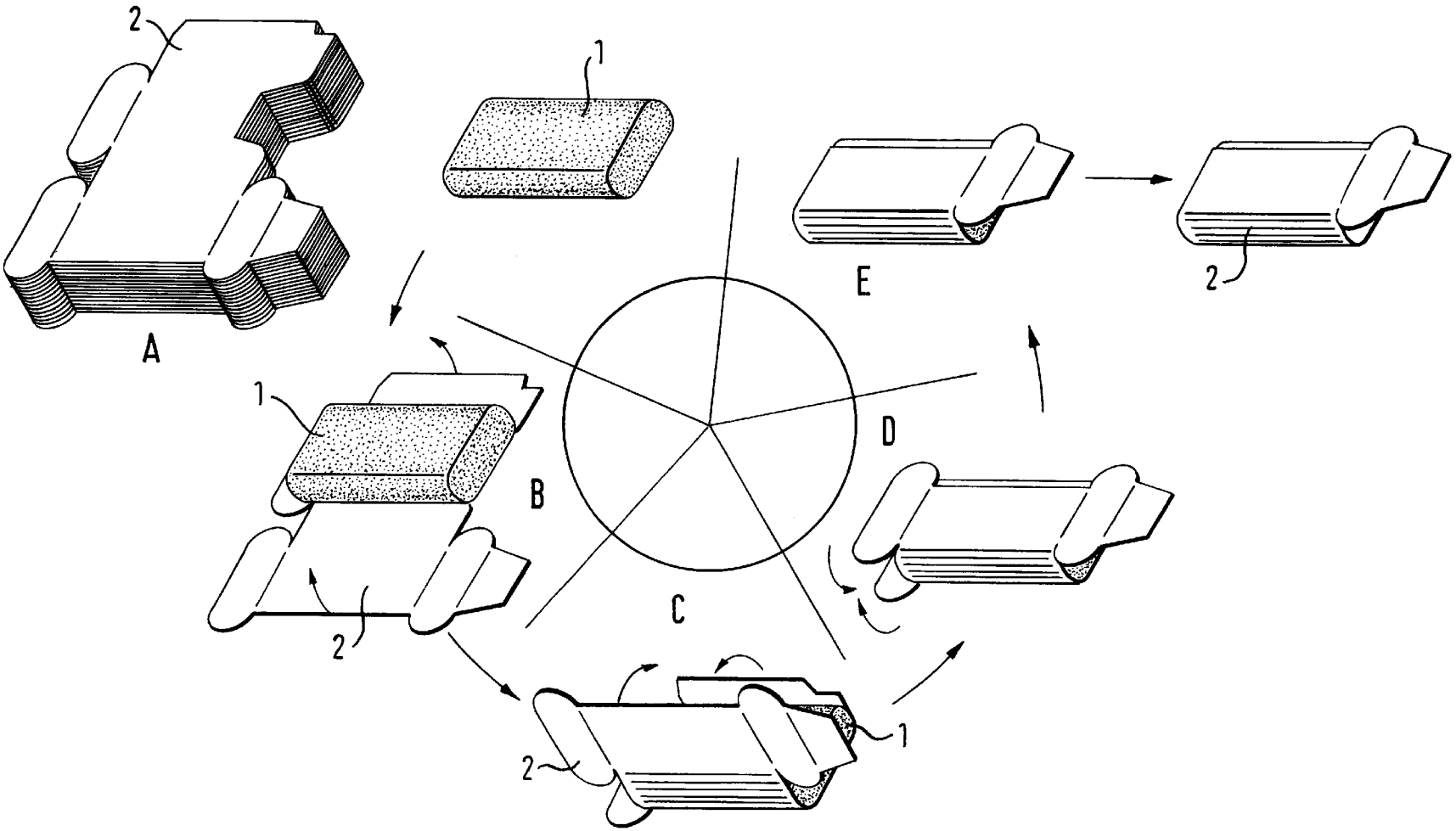
Figure 13:
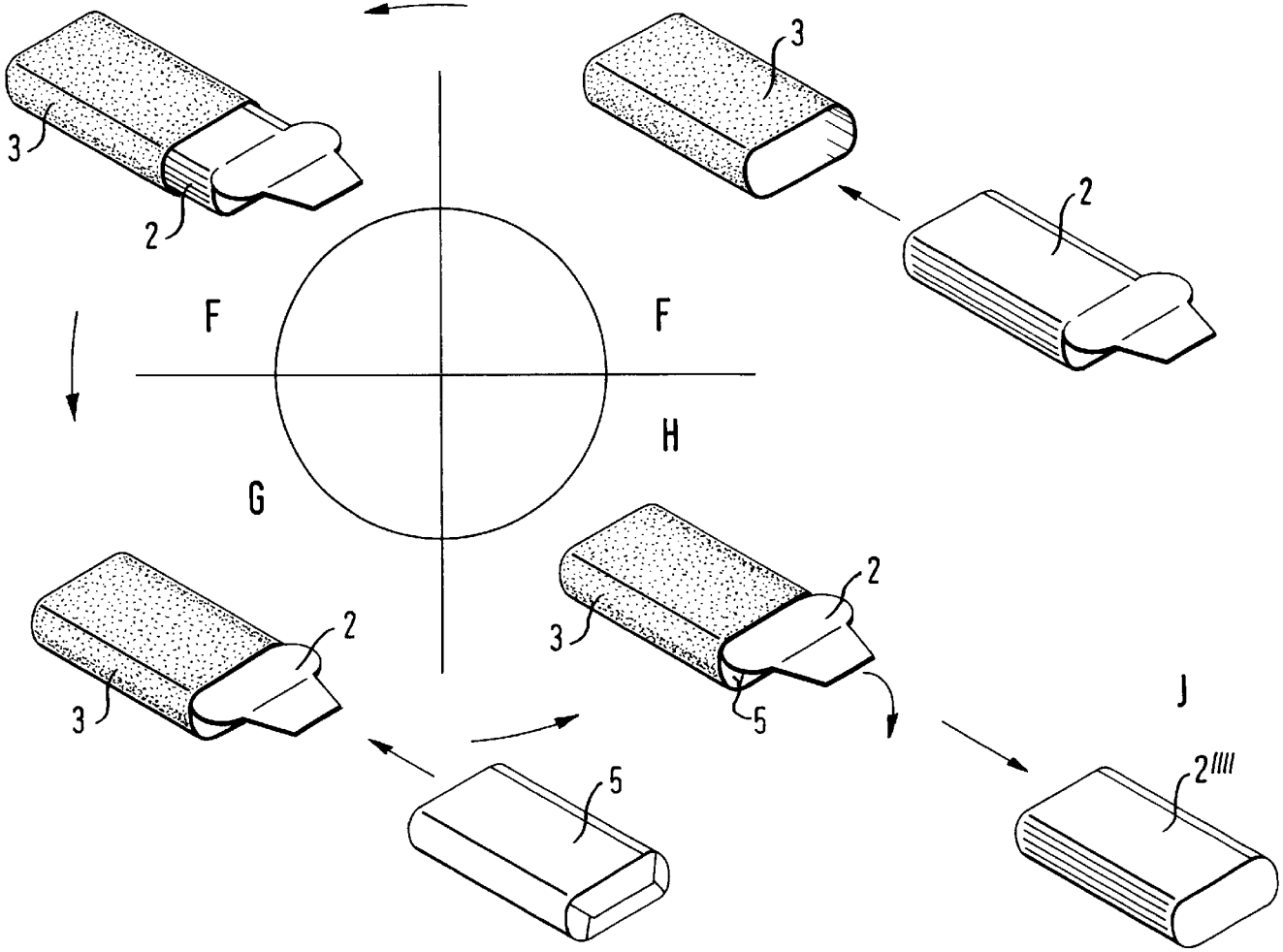
Figure 14A:
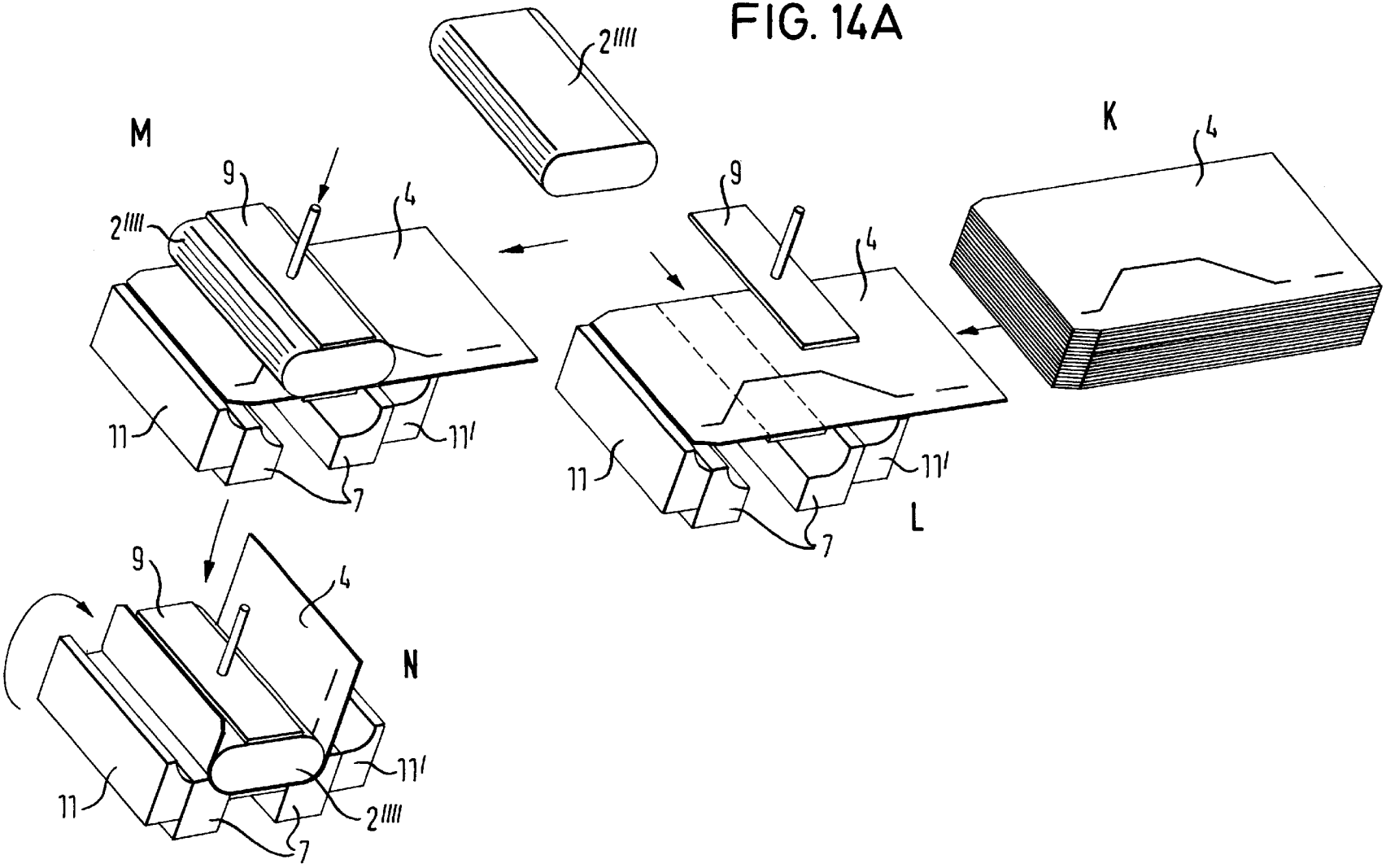
Figure 14B:
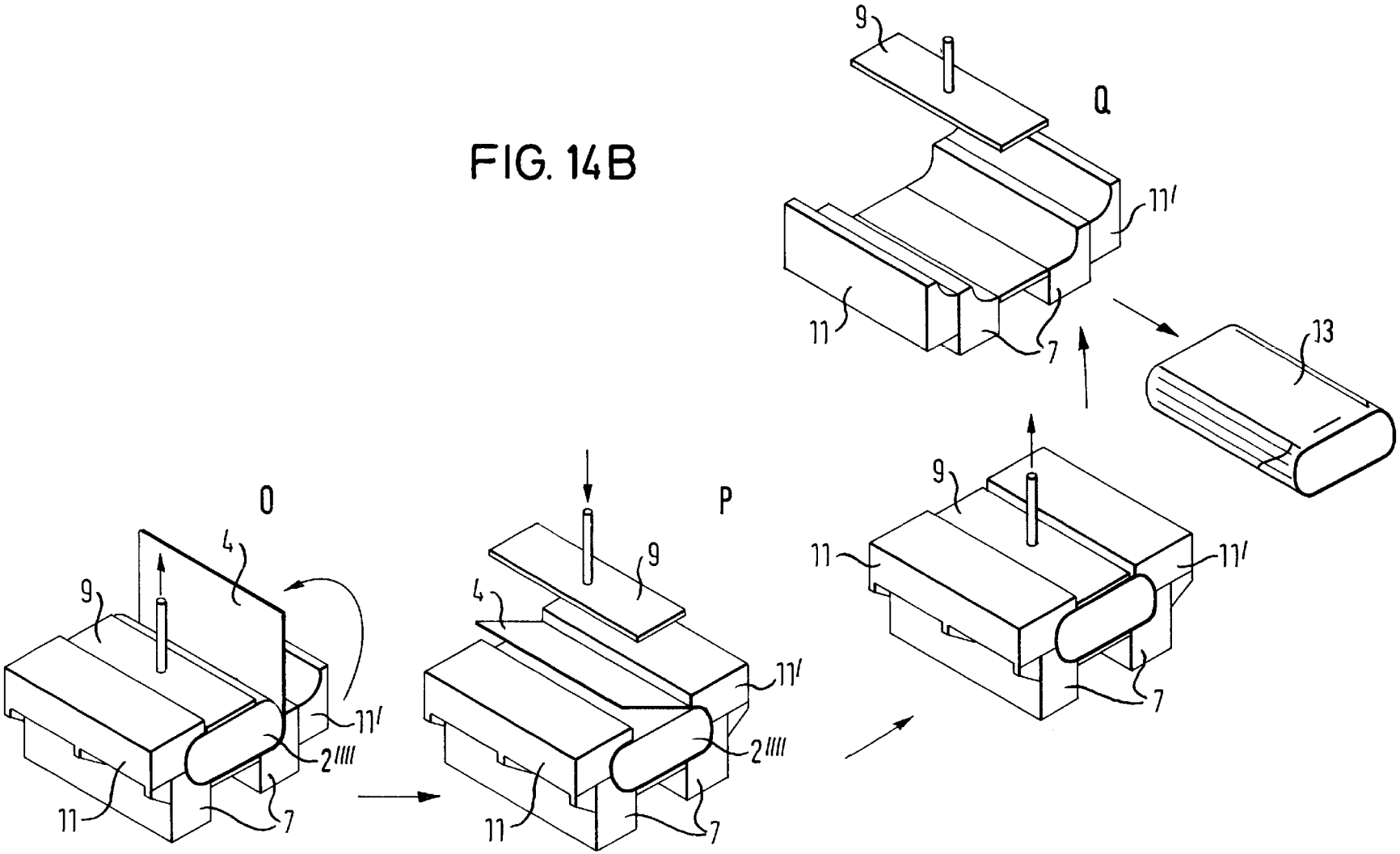
Figure 15:
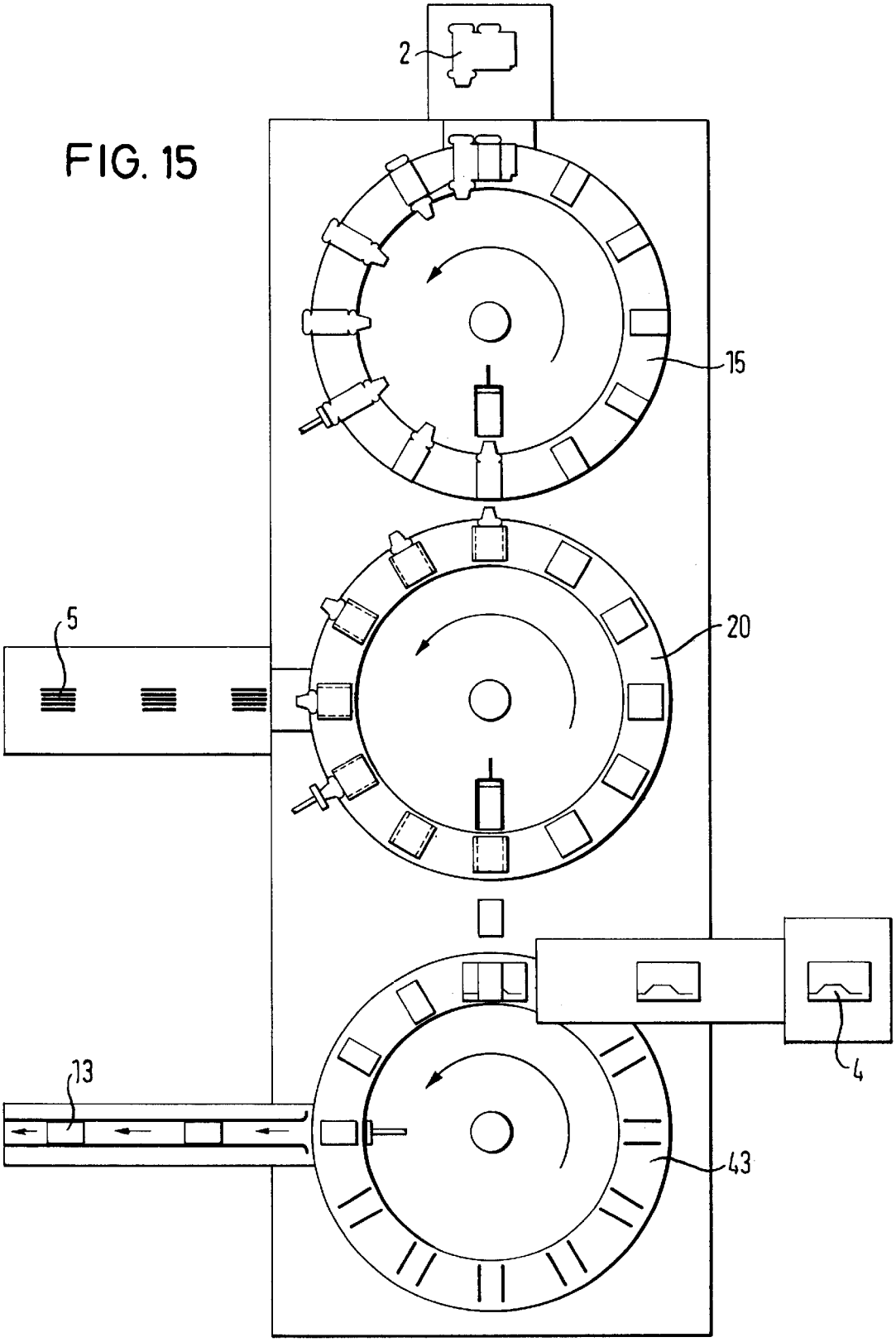

The invention is described in more detail below with reference to embodiments; there are shown in:

FIG. 1 the inside part of a first version;

FIG. 2 the casing of the first version;

FIG. 3 the inside part of a second version;

FIG. 4 the casing of the second version;

FIG. 5 the casing of a third version;

FIG. 6 the inside part of the third version;

FIG. 7 the casing of a fourth version;

FIG. 8 the inside part of the fourth version;

FIG. 9 the inside part of a fifth version;

FIG. 10 the casing of the fifth version;

FIG. 11 a cigarette pack which can be produced with any one of the blanks according to FIGS. 1 to 10;

FIG. 12 a representation of a sequence of process steps in which it is shown how the inner carton of a cigarette pack is produced from an inside part blank;

FIG. 13 a representation of a sequence of process steps in which the filling of the inner carton with a cigarette block is shown;

FIG. 14A a representation of the first part of a sequence of process steps in which the placing of an outer carton blank round the inner carton is shown;

FIG. 14B a representation of the second part of a sequence of process steps in which the placing of the outer carton blank round the inner carton is shown; and FIG. 15 a schematic plan view of a device for the production of cigarette packs.

In the figures, identical parts are given the same reference numbers throughout, while in the case of similar or corresponding parts an apostrophe (') or a quotation mark (") is added. The blanks are moreover represented on a scale of roughly 1:1.

FIG. 1 shows the inside part 2 of a first version of a blank for a cigarette pack which is produced from left to right from an essentially rectangular strip which firstly forms a back 14' to which is joined a first side section 18', with pre-grooved folding lines 17 which extend over the whole width of the blank. The front 12' is joined to the first side section 18' provided with folding lines 17, and passes into the second side section 16' which, like the first side section 18', is provided with pre-grooved folding lines 17 which extend over the whole width of the blank. A first adhesive flap 19, which does not extend over the whole width of the blank, is joined to the second side section 16'.

A U-shaped collar cut-out 21 with rounded corners 22, which serves to facilitate access to the cigarettes, is provided at the upper rim of the front 12'. A second adhesive flap 23, which has roughly the shape of a base 6 that has not been mentioned thus far, is joined to the lower rim of the front 12'. The base 6 has the basic shape of a rectangle which is joined to the lower rim of the back 14' and the length of which corresponds to the width of the back 14'. A semi-circular surface is moulded in each case onto the two short sides of the rectangle so that a roughly oval shape results for the base 6.

A top 8, the shape of which is congruent with the shape of the base 6, is joined to the back 14' on the other side of the blank lying opposite the base 6. A folding line 31 runs parallel to the rim 28 of the top 8 at a distance from the rim 28 of the top 8 adjacent to the back 14' and ends at a slot 30 which runs at a right angle to the folding line 31 as far as the upper rim of the blank. A cap section 34 is thereby formed by means of which the top 8 can be folded out rearwards in the finished cigarette pack.

A third adhesive flap 32, which is later glued to the front part of a casing 4, is joined to the front edge 29 of the top 8 lying opposite the back-rim 28. An insertion flap 33, which serves to lock the pack again once it has been broken open, is also joined to the third adhesive flap 32.

FIG. 2 shows the casing 4 which later encloses the glued inside part 2 and is completely visible apart from the base 6 and top 8 in the finished package according to FIG. 11. To this end, the casing 4 is rectangular apart from a fourth adhesive flap 40 which is joined to a short side of the casing 4, for example to the left-hand side section 18. Running over the upper half of the casing 4 is a curved opening edge 10 which is designed as a cut line 10' in the solid-line section and as a hinge line 10" in the part indicated by a dashed line. The hinge line 10" thus runs over the back 14 of the casing 4, while the cut line 10' of the opening edge 10 runs over the front 12 and the adjoining side sections 16 and 18.

FIG. 3 shows the casing 4' of a second version which essentially corresponds to the casing 4 of FIG. 2. The difference is that in the region of the front 12 the base 6 is moulded on below and the top 8 above. Furthermore, a fifth adhesive flap 42 which is roughly congruent with the top 8 is moulded above onto the back 14.

FIG. 4 shows the inside part 2' which together with the casing 4' forms the cigarette pack represented in FIG. 11. The inside part 2' has essentially the same shape as the front 12' from FIG. 1 with the side sections 16' and 18' joined thereto which are in each case provided with the folding lines 17. In addition, the second adhesive flap 23 for the inside part of the base 8 is joined below to the front 12', while the collar cut-out 21 with the rounded corners 22 is provided above.

It is pointed out that the adhesive flap 23 for the base 8 can also be attached to the casing 4' according to FIG. 3, which would correspond to a version according to FIG. 5. In this case the inside part 2' of FIG. 4 would have a roughly rectangular shape with a straight lower rim, while the collar cut-out 21 with the rounded corners 22 remains in the upper rim.

FIG. 5 shows another version for the casing 4", essentially in accordance with FIG. 3 but with a third adhesive flap 23 attached below to the back 14 for the base 6, while the fifth adhesive flap 42 for the top 8 is attached to the upper rim of the back 14.

The casing 4' is expediently used with an inside part which essentially consists of a collar 25. The collar 25 again has the collar cut-out 21 with rounded corners 22, as can be recognized in the region of the front 12' of FIG. 1. However, the collar 25 does not extend over the whole height of the blank, but has a height reduced by roughly ⅔ and a lower rim 27 the shape of which roughly corresponds to the shape of the collar cut-out 21. Wings 26, which again are provided with pre-grooved folding lines 17 as in the version according to FIG. 1, are joined to the collar cut-out 21 on the right and on the left. The pre-grooved folding lines 17 extend over the whole height of the collar 25.

FIG. 7 shows a fourth version of the invention, in which the casing 4'" essentially corresponds to the casing 4' of FIG. 3, but with the variation that the base 6 is not part of the casing 4'", but is joined to the inside part 2" represented in FIG. 8.

FIG. 8 shows the inside part 2", which can expediently be used in conjunction with the case 4'" for the production of a cigarette pack according to FIG. 11. The inside part 2" has essentially the shape of the inside part 2 according to the version of FIG. 1, with only the top 8 with the adhesive flap 32, the insertion flap 33 and the cap section 34 being omitted.

FIG. 9 shows the inside part 2'" of a fifth version of a blank for a cigarette pack, in which once again parts which are the same as in the first version according to FIG. 1 are given the same reference numbers. The two inside parts 2 and 2'" differ firstly in that the fifth adhesive flap 42' is joined to the back 14' instead of the top 8 and secondly in that there is seated in the collar cut-out 21 a tongue 24 which is suspended with the collar cut-out 21 at a few points 44 and thus can be broken off from the collar cut-out 21 when the pack is opened. Attached to the upper end of the tongue 24 is a first tab 35 the length of which corresponds roughly to the width of the collar cut-out 21 and the width roughly to half the width of the top 8 or of the fifth adhesive flap 42'.

Joined to the front 12' on the opposite side, at the point from which in the version according to FIG. 1 the second adhesive flap 23 is suspended, is a second tab 36 the length of which corresponds roughly to the width of base 6 and the width roughly to half the width of the base 6. Further, the second adhesive flap 23' is suspended from the lower end of the back 14'.

Upon assembly, the inside part 2'" is first bent around a format body until the first adhesive flap 19 can be glued fast to the inside of the back 14' in such a way that a sealed casing is formed. The first and second tabs 35 and 36 are then folded inwards, while the second and fifth adhesive flaps 23' and 42' are then folded over the first and second tabs 35 and 36 and glued to these.

It is pointed out that this means only the folding of the inside part for the explanation of the structure of the cap box which is thus produced, while in the case of the explanation above there was initially no consideration whatever of the insertion of the cigarette block. This is explained later.

In addition, a C-shaped slot 38 is further provided in each of the side sections 16' and 18' in the vicinity of the upper rim of the inside part 2'" and thus at the rim which is later adjacent to the top 8, the openings of the C-shapes facing one another. When the inside part 2'" is sealed, this results in two noses projecting outwards in opposite directions, by means of which the cap of the pack is kept closed.

FIG. 10 shows the casing 4"" belonging to the inside part 2'" of the fifth version, which differs from the casing 4 according to FIG. 2 only in that the base 6 is joined to the front wall 12 of the casing 4""below and the top 8 above. In addition, a third tab 37 is attached to the back wall 14 above and a fourth tab 39 below. The third and fourth tabs 37 and 39 each have the same length as the width of the front wall 14, while their width corresponds roughly to half the width of the base 6 and of the top 8 respectively.

In addition, in the fifth version four triangular adhesive tongues 41, the apices of which point outwards and which likewise are provided for gluing to the base 6 and to the top 8 respectively, are joined above and below to each of the side sections 16 and 18. The triangular shape of the adhesive tongues 41 makes it possible for the side sections 16 and 18 to bent in a semi-circular shape.

It is clear that the various elements can also be combined with one another in such a way that a cigarette pack according to FIG. 11 can always be produced even if the arrangement of the individual wall sections is differently chosen.

FIG. 12 shows a sequence of process steps for the production of the inside part 2 for a cigarette pack which has a roughly ovally shaped cross-section. For this, in a first step A a flat-lying inside part blank 2 is removed by suction from a blanks magazine with the help of below-atmospheric pressure. Then in a second step B a format body 1 is placed over this blank 2. Then in step C the back of the inside part and the side section of the inside part which are formed from the inside part blank 2 are raised.

Subsequent to this, the first adhesive flap of the inside part side section is glued and in step D is shaped round the format body 1. The back of the inside part blank 2 is then also shaped round the format body 1, pressed onto the glued flap of the inside part and thus glued to the inside part. Thereafter one of the base covers of the inside part blank 2, which previously have also been called adhesive flaps, is glued and folded round the format body 1. The other base cover of the inside part blank 2 is then folded onto the already-glued base cover and glued to the latter.

In step E, finally, the glued inside part 2, which is open at its top side, is pulled off from the format body 1.

FIG. 13 shows a sequence of process steps in which the filling of the previously produced inside part 2 is shown. For this, in step F the inside part 2 which is open at its top side is pushed into a hollow format body 3.

In step G a cigarette block 5 wrapped in for example aluminium foil is pushed into the inside part 2 located in the hollow format body 3.

In step H the cover flap on the top side of the inside part 2 is folded and inserted into the hollow format body 3.

In step J, finally, the sealed inside part 2, which is filled with cigarettes, is pushed out of the hollow format body 3.

A sequence of process steps is shown in FIGS. 14A and 14B, in which the placing of a casing blank 4 round the filled inside part 2 to the stage of the finished cigarette pack is represented. Firstly in step K the flat-lying casing blank 4 is removed by suction from a blanks magazine with the help of below-atmospheric pressure, then glued over its whole surface and subsequently brought over a format pocket 7 in step L. The filled inside part 2, which now has the function of a format body, is then brought on to the casing blank 4 in step M and pressed into the format pocket 7 with the help of a ram 9 (step N), as a result of which the side sections 16, 18 and the back 14 of the casing blank 4, by which the back of the cigarette pack is later formed, are bent upwards and the side section 18 is then pressed round the inside part 2 with the help of the format cheek 11. At the same time, the ram 9 is returned to the starting position (step 0).

The back part of the casing blank 4 is shaped round the format cheek 11' in step P. The ram 9 then presses from above against the back part in order to glue the latter to the inside part 2.

In step Q the format cheeks 11 and 11' are opened again, and the ram 9 travels upwards into the basic position. Thereafter the finished cigarette pack 13 is ejected from the format pocket 7.

FIG. 15 shows a schematic plan view of a device for the production of the cigarette packs 13. Firstly the inside part blanks 2 that are held in a blanks magazine at the top end of the device are transported by means of below-atmospheric pressure into associated positions on a first turntable 15. There, the inside part blanks 2 are worked into inside parts according to process steps A to E. These inside parts are then transferred onto a second turntable 20 on which the inside parts are filled with cigarettes according to process steps F to J. The cigarette blocks 5 which are wrapped in for example aluminium foil are supplied via a conveyor belt.

The filled inside parts are then transferred onto a third turntable 43 on which process steps K to Q are carried out. The finished cigarette packs 13 are then removed from the device via a conveyor belt.

What is claimed is:

1. A cigarette pack comprising:

a first blank for defining an inside part including a front, a back, side sections connecting the front and back and a collar cutout;

a casing for surrounding the inside part and formed from a second blank, said casing having a front, a back, side sections connecting the front and the back, and an opening edge for forming a flap top, together with first tabs hingedly connected to the front and the back, respectively, for covering a base of said casing, and second tabs hingedly connected to the front and back of the casing for covering the flap top, said first and second blanks having substantially the same length;

said inside part including a first tab and an adhesive flap connected to the front and the back, respectively, for covering a top of the inside part and a second tab and an adhesive flap each being connected to the front and the back, respectively, for covering a bottom of the inside part;

said inside part including a tongue connected within a collar cutout of the inside part blank at a few spaced points thereof, one of the tabs of the inside part being connected to an upper distal end of the tongue; and said first tabs of the inside part and casing, respectively, being arranged and dimensioned such that they face one another but do not overlap after folding the blanks of the pack.

2. A pack according to claim 1 including generally triangularly-shaped adhesive tongues connected to the side sections of the casing.

3. A pack according to claim 1 wherein an opening edge of the casing blank is formed as a cut line along the front and two side sections thereof and a hinge line is formed along the back of the casing blank.

4. A pack according to claim 1 wherein an upper part of the back of the inside part first blank includes a pivotable cap section formed by a transversely extending folding line and a slot extending along an adjoining side section.

5. A pack according to claim 4 wherein an opening edge of the casing blank is formed as a cut line along the front and two side sections thereof and a hinge line is formed along the back of the casing blank.

6. A process for the production of a cigarette pack wherein the pack includes a first blank for defining an inside part including a front, a back, side sections connecting the front and back and a collar cutout, said inside part further including a first tab and an adhesive flap connected to the front and the back, respectively, for covering a top of the inside part and a second tab and an adhesive flap each being connected to the front and the back, respectively, for covering a bottom of the inside part and a casing for surrounding the inside part and formed from a second blank, said casing having a front, a back, side sections connecting the front and the back, and an opening edge for forming a flap top, together with first tabs hingedly connected to the front and the back, respectively, for covering a base of said casing, and second tabs hingedly connected to the front and back of the casing for covering the flap top, comprising the steps of:

shaping the inside part first blank about a format body;

folding the tab and flap at the bottom of the inside part and gluing the tab and flap thereof to one another;

placing a cigarette block into the inside part after removal of the inside part from the format body and through an opening at the top of the inside part;

closing the top of the inside part such that the tab and flap thereof overlie one another;

thereafter disposing the casing blank about the inside part and gluing the inside part and the casing to one another such that the first and second tabs of the casing overlie the adhesive flaps of the inside part and underlie the base flap and the top flap of the casing.

7. A process according to claim 6 including using a format pocket to dispose the casing blank about the inside part.

8. A process according to claim 6 including holding the inside part on the hollow format body while the inside part is filled with the cigarette block.

* * * * *